US008746759B2

(12) United States Patent
Bailey et al.

(10) Patent No.: US 8,746,759 B2
(45) Date of Patent: Jun. 10, 2014

(54) DOOR HANDLE ASSEMBLY

(76) Inventors: Steve Bailey, London (CA); John Cunningham, Strathroy (CA)

( * ) Notice: Subject to any disclaimer, the term of this patent is extended or adjusted under 35 U.S.C. 154(b) by 0 days.

(21) Appl. No.: 13/335,856

(22) Filed: Dec. 22, 2011

(65) Prior Publication Data

US 2012/0102713 A1 May 3, 2012

Related U.S. Application Data

(62) Division of application No. 11/778,830, filed on Jul. 17, 2007, now abandoned.

(60) Provisional application No. 60/831,897, filed on Jul. 18, 2006.

(51) Int. Cl.
*E05B 3/00* (2006.01)
*E05B 1/00* (2006.01)

(52) U.S. Cl.
USPC ..... 292/336.3; 292/DIG. 64

(58) Field of Classification Search
USPC ..... 292/113, 336.3, 347, 348, 350, 352, 292/DIG. 31, DIG. 38, DIG. 61, DIG. 64
See application file for complete search history.

(56) References Cited

U.S. PATENT DOCUMENTS 3,424,510 A * 1/1969 Moon ..... 312/284
3,471,874 A * 10/1969 Dixon ..... 4/240
4,038,718 A * 8/1977 Reilhac et al. ..... 292/336.3
4,993,763 A 2/1991 Tanimoto et al.
5,263,750 A * 11/1993 Smith et al. ..... 292/336.3
5,895,081 A 4/1999 Tanimoto et al.
6,036,244 A * 3/2000 Tyves et al. ..... 292/336.3
6,167,779 B1 1/2001 Sano et al.
6,264,254 B1 7/2001 Siegfried et al.
6,460,904 B1 10/2002 Stapf
6,460,905 B2 10/2002 Suss
6,976,717 B2 * 12/2005 Barr et al. ..... 292/336.3
6,988,752 B2 1/2006 Belchine, III et al.
7,104,575 B2 * 9/2006 Kakita ..... 292/348
2005/0146147 A1 7/2005 Niskanen et al.

* cited by examiner

*Primary Examiner* — Carlos Lugo
*Assistant Examiner* — Alyson M Merlino
(74) *Attorney, Agent, or Firm* — Dickinson Wright, PLLC

(57) ABSTRACT

A handle assembly for a vehicle door includes a back plate, including a recessed region displaced away from the exterior surface of the vehicle door. A handle aperture is provided within the recessed region of the back plate with at least one pin mount integrally formed within the recessed region of the back plate. The pin mount includes a void and a slot that is narrower than the void. A handle is pivotally mounted to the back plate and located at least partially within the recessed region, the handle having at least one integrally-formed pin extending at an angle substantially parallel to the body of the handle; the pin operable to be seated in the aperture to allow pivotal movement of the handle. The handle further includes a spring locator operable to retain a handle spring prior to mounting the handle to the back plate.

22 Claims, 6 Drawing Sheets

DOOR HANDLE ASSEMBLY

CROSS REFERENCE TO RELATED APPLICATIONS

This application is a divisional of U.S. patent application Ser. No. 11/778,830 filed on Jul. 17, 2007, now abandoned which claims the benefit of and priority to U.S. Provisional Application No. 60/831,897, filed Jul. 18, 2006. All applications are incorporated herein by reference in their entireties.

FIELD OF THE INVENTION

The present invention relates to vehicles doors. More specifically, the present invention relates to a handle assembly used to actuate the latch for vehicle doors.

BACKGROUND OF THE INVENTION

Automotive manufactures are looking to reduce the cost of vehicle components. One way to reduce costs is to reduce the number of parts used in a component, simplifying both component assembly and supply chain management. Another way is to engineer the component so that it can be assembled more quickly and without expensive equipment. For example, U.S. Pat. No. 6,039,366 to Lewis teaches a handle assembly that includes an escutcheon plate sized to fit in the door aperture; a handle pivotally mounted on the escutcheon plate via an axial pin; a threaded fastener device secured to the escutcheon plate and extending inwardly; and a clip of U-configuration. Once the door handle assembly has been installed in the aperture of the vehicle door skin, the door handle assembly may be mounted simply by tightening the threaded fastener.

U.S. Pat. No. 6,052,948 to Spitzley teaches a method of mounting a motor vehicle door handle assembly on a skin of a door assembly where the handle assembly includes a handle member and a base plate defining a planar surface. A plurality of individual, spaced lug apertures and a separate spaced clip aperture are provided in the door skin. Lugs are provided on the handle base plate, each sized to pass through a respective lug aperture in the door skin to retain the handle assembly on the door skin. The handle includes a depending, hook that extends through an aperture in the base plate that is operable to be connected to a cable to actuate a latch.

U.S. Pat. No. 6,059,329 to Spitzley teaches a method of mounting a motor vehicle door handle assembly to a vehicle door consisting of locating a pre-assembled handle assembly within a door skin aperture, and actuating the handle assembly to fixedly mount the handle assembly.

While the above-described patents all describe handle assemblies that can be mounted to a door more quickly, it is still desirable to provide a reduced-cost handle assembly and mounting method.

SUMMARY OF THE INVENTION

According to the present invention there is provided a handle assembly for a vehicle door, comprising:

- a back plate, operable to be mounted to a portion of the vehicle door, the back plate including a recessed region displaced away from an exterior surface of the vehicle door,
- a handle aperture within the recessed region of backplate;
- at least one pin mount integrally formed within the recessed region of the bookplate, the pin mount including a void and a slot that is narrower than the void;

- a handle, pivotally mounted to the backplate and located at least partially within the recessed region, the handle having at least one integrally-formed pin extending at an angle substantially parallel to the body of the handle; the pin operable to be seated in the aperture to allow pivotal movement of the handle.

This invention provides a simple handle assembly for a vehicle door, with a reduced number of elements that is economical to produce and at the same time does not limit the function.

BRIEF DESCRIPTION OF THE DRAWINGS

Preferred embodiments of the present invention will now be described, by way of example only, with reference to the attached Figures, wherein.

DETAILED DESCRIPTION OF THE INVENTION

Figure 1A:
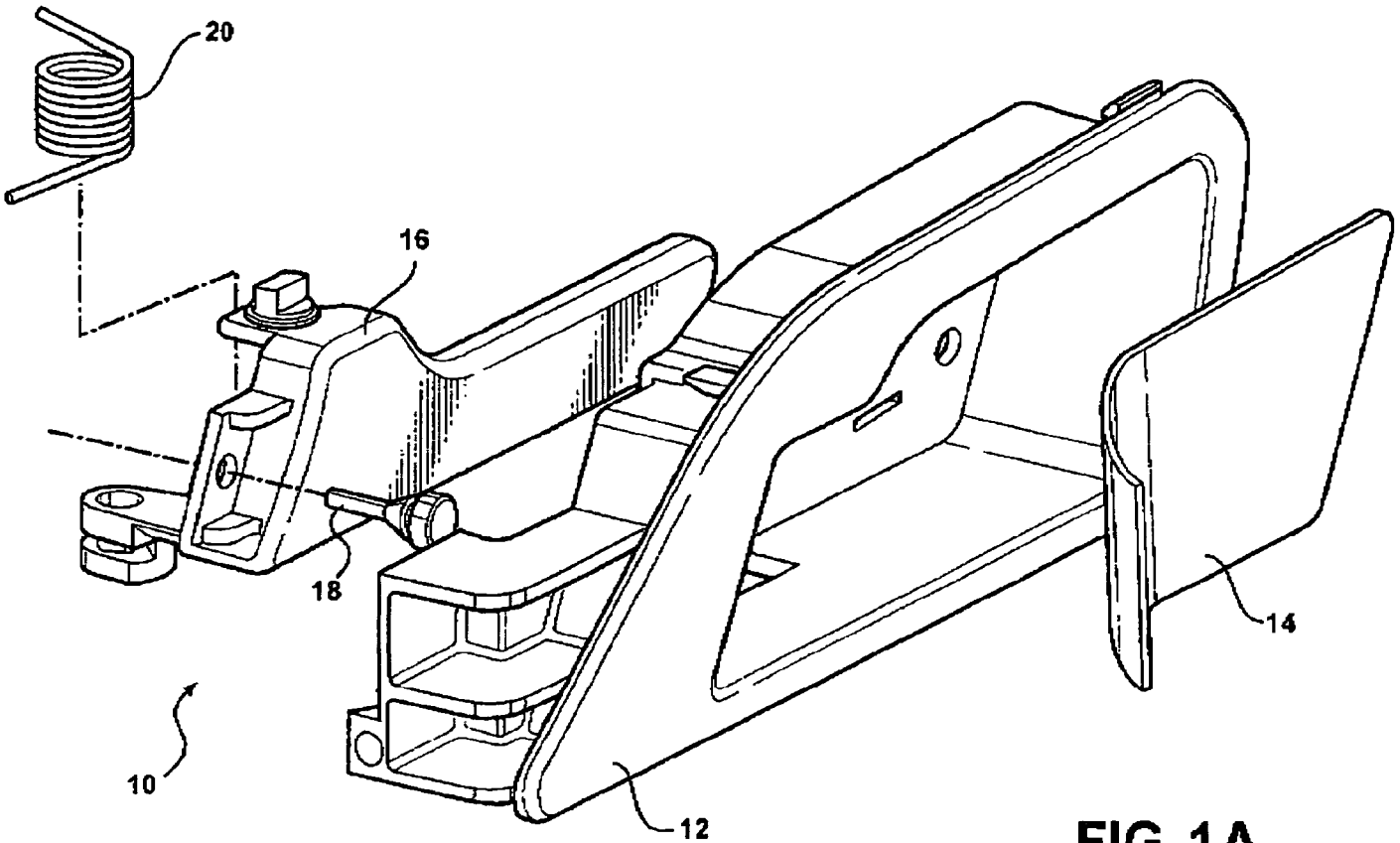
FIGS. 1A and 1B are exploded views of a handle assembly according to a first embodiment of the invention.
Figure 1B:
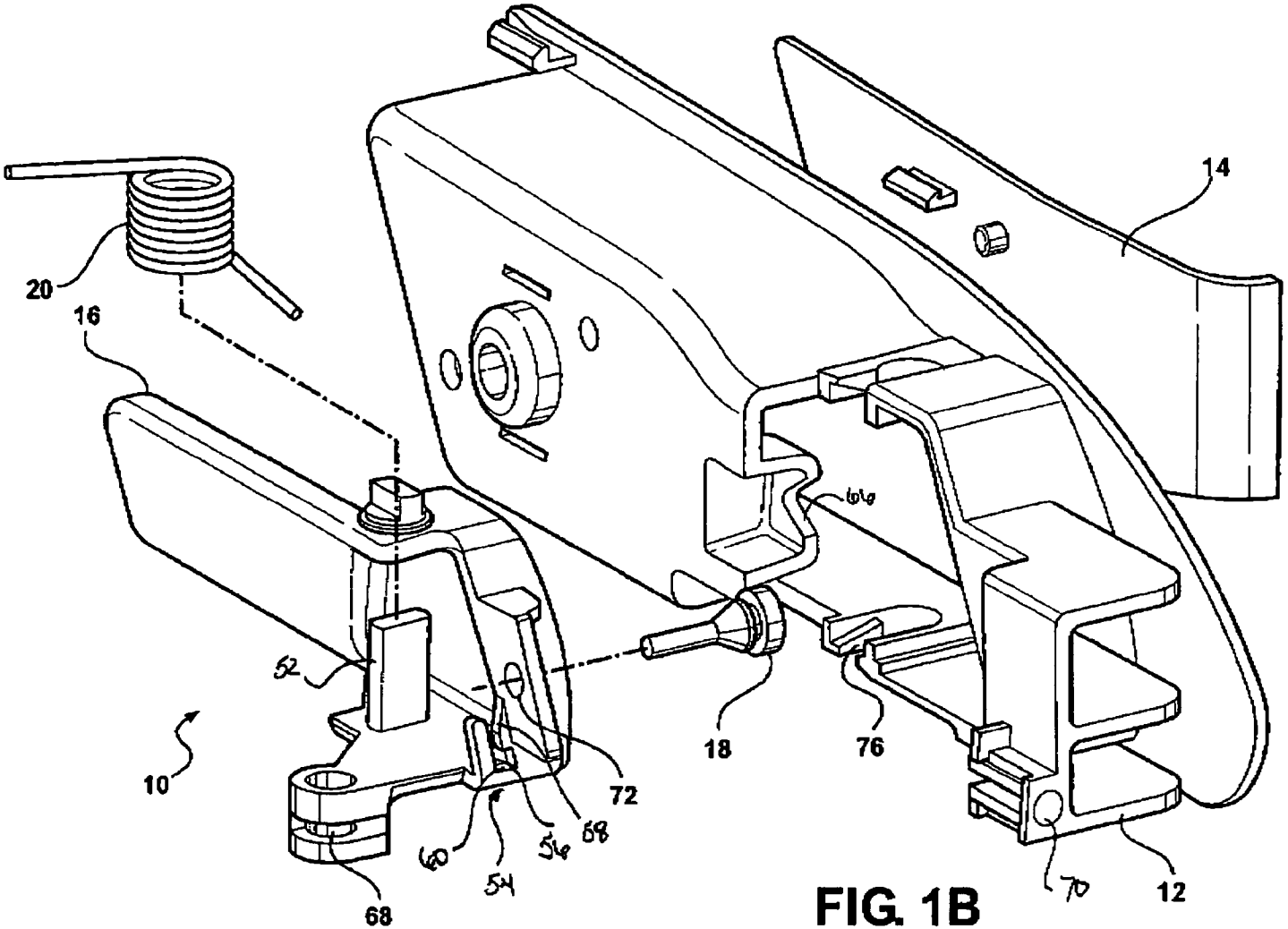

Referring now to FIGS. 1A and 1B, a first embodiment of the invention is shown generally at 10. FIG. 1A shows the "A-side", or exposed side of handle assembly 10, and FIG. 1B shows the "B-side", or concealed side of handle assembly 10. Handle assembly 10 includes a backplate 12, a cover plate 14, a handle 16, a bumper 18, and a torsion spring 20. During assembly, bumper 18 and torsion spring 20 are pre-mounted to handle 16, which is then pivotally mounted to backplate 12. The mounting of bumper 18 and torsion spring 20 are described in greater detail below. Once assembled (FIGS. 2A and 2B), handle assembly 10 is mountable to an aperture in a vehicle door skin (not shown), and secured to either the door itself or to an internal equipment module (also not shown).

Figure 2A:
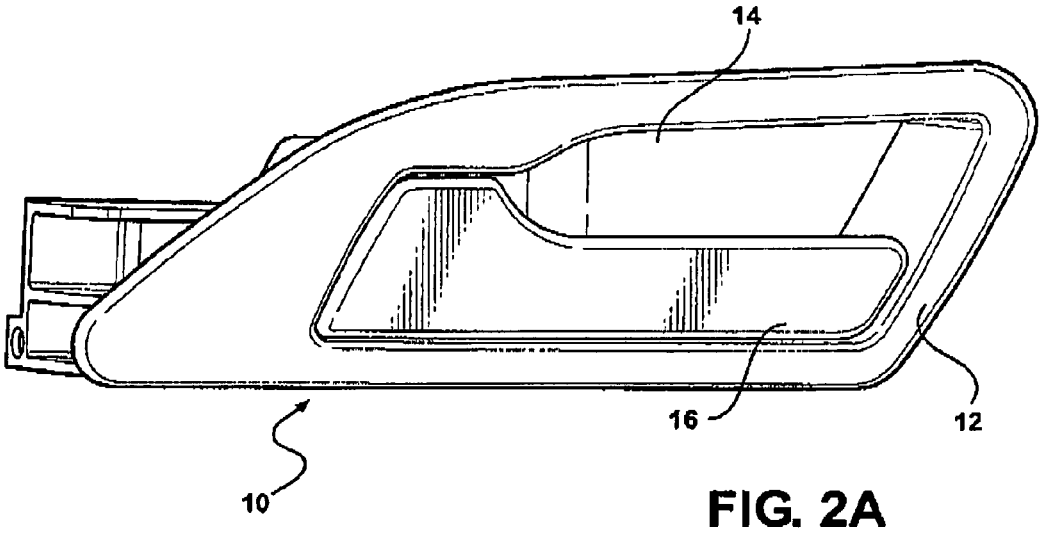
FIGS. 2A and 2B are A side-facing and B side-facing perspective views of the handle assembly shown in FIGS. 1A and 1B.
Figure 2B:
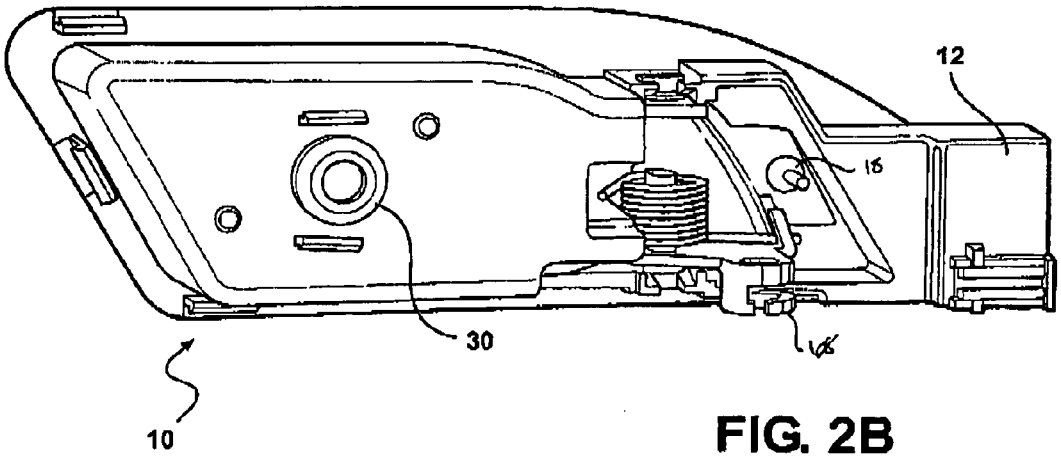
Figure 3:
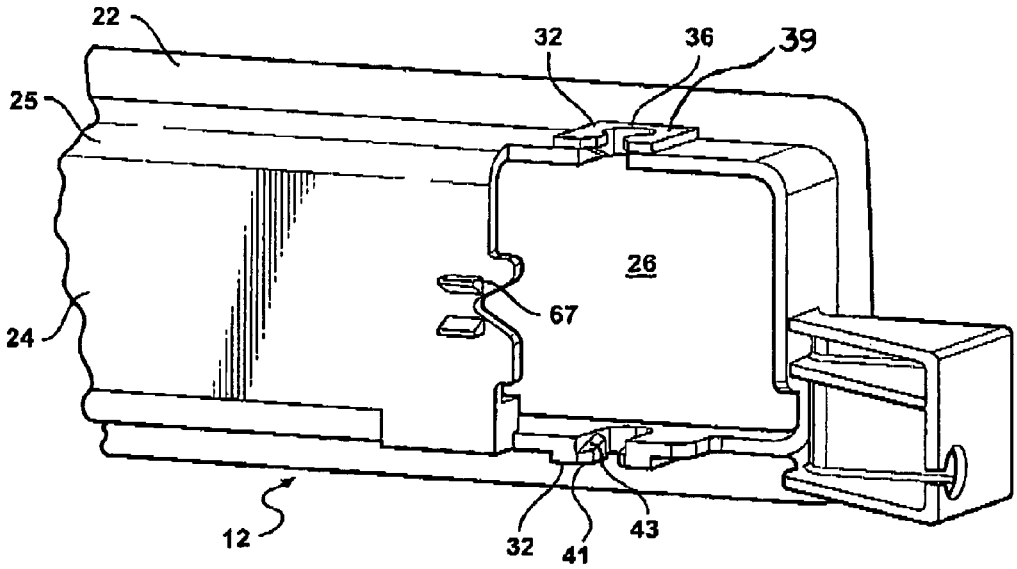
FIG. 3 is an B side-facing perspective view of a portion of a backplate constructed according to an alternative embodiment for the handle assembly shown in FIGS. 1A and 1B.

Referring now to FIG. 3, an alternative embodiment or configuration of backplate 12 is shown and includes a perimeter flange 22 shaped to match the contours of the A side sheet metal or trim panel of the vehicle door skin (not shown), and a concave region 24 that is recessed into the door (relative to the A side). A web portion 25 interconnects perimeter flange 22 and concave region 24. A handle aperture 26 is provided within concave region 24 to insert handle 16 (described in greater detail below). At least one fastener aperture hole 30 (FIG. 2B) is provided within concave region 24 to locate screws or other such fasteners to secure backplate 12 to the vehicle door. Cover plate 14 is fitted so as to cover over a portion of concave region 24 and to hide the securing fasteners (FIG. 2A).

Figure 7:
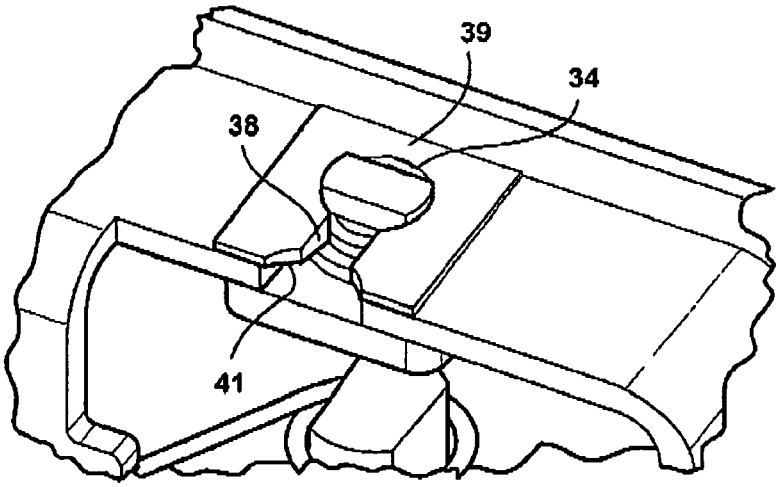

Referring now to FIGS. 3 and 7, within web portion 25, on opposite sides of handle aperture 26 is a pair of pivot mounts 32. The two pivot mounts 32 each include a generally cylindrical wall 34 defining a void 36. A slot 38 is provided in web portion 25 interconnecting handle aperture 26 with void 36. A bezel 39 runs along the periphery of cylindrical wall 34. At the mouth of each slot 38 is a curved surface 41 to help locate handle 16 prior to the insertion of handle 16 into pivot mounts 32. Along the sidewalls of slot 38 is a ramp portion 43 to ease the snap-in insertion of handle 16 and to retain the handle 16 relative to backplate 12 after insertion therein.

Figure 4:
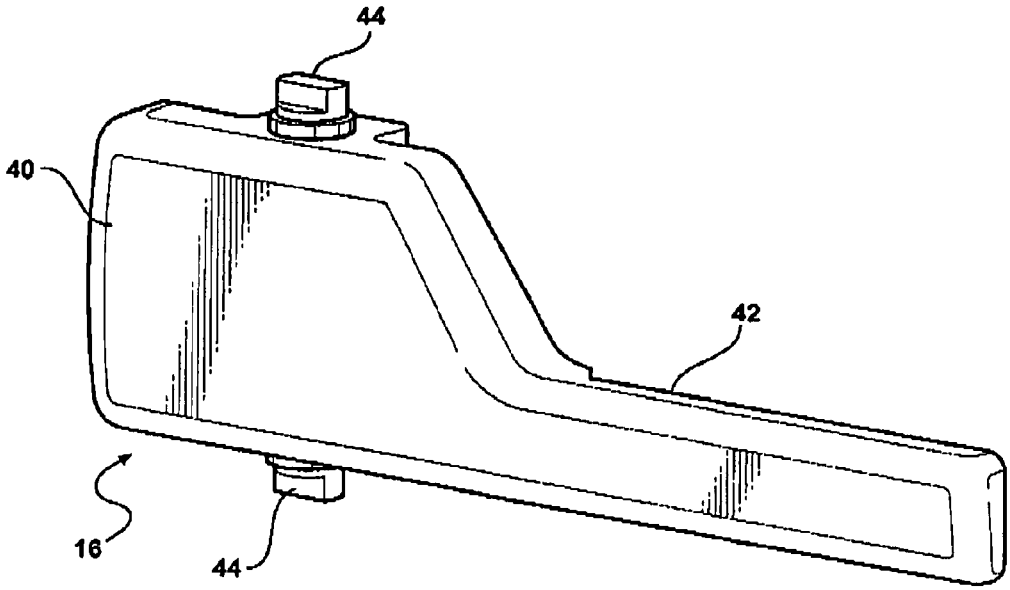
FIG. 4 is an A side-facing perspective view of a handle constructed according to an alternative embodiment for the handle assembly shown in FIGS. 1A and 1B.
Figure 5:
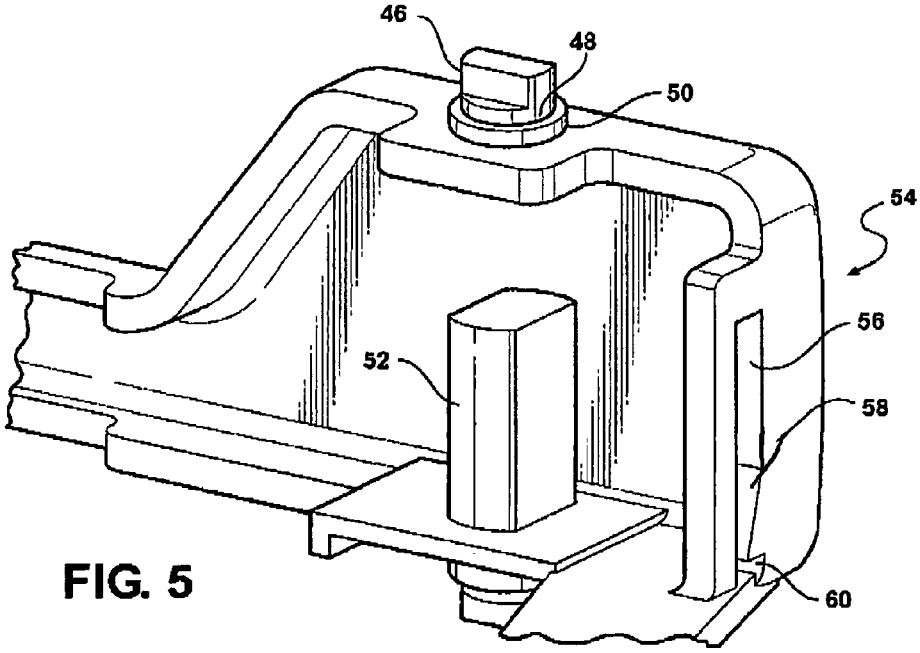
FIG. 5 is an B side-facing perspective view of a portion of the handle shown in FIG. 4.
Figure 6:
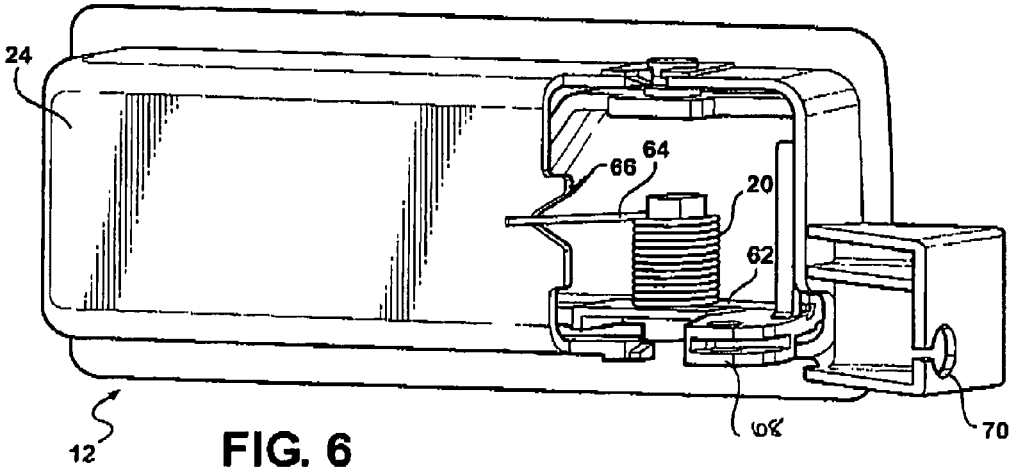
FIGS. 6 and 7 are perspective views of the a handle assembly according to an alternative embodiment showing the handle of FIGS. 4 and 5 mounted to a backplate similar to the backplate shown in FIG. 3.

Referring now to FIGS. 4 and 5, an alternative embodiment or configuration of handle 16 is shown in greater detail. Handle 16 includes an integrally-formed handle body portion 40 and a narrower handle arm portion 42 adapted for grasping. A pair of integrally-formed pins 44 form the pivot axis for handle 16. When handle 16 is inserted into handle aperture 26, pins 44 are guided into pivot mounts 32. Each of pins 44 includes a guide section having a pair of D-flat portions 46, a cylindrical pivot segment or surface 48, and a bearing surface 50. The D-flat portions 46 help locate handle 16 in an "assembly" position prior to installation and to guide handle 16 into voids 36 during manual assembly of handle 16 into backplate 12. The D-flat portions 46 are sized to fit within slot 38 when the handle 16 is inserted generally perpendicular into handle aperture 26 and to retain handle 16 when the handle is non-perpendicular relative to backplate 12. Each pivot surface 48 interfaces with bezel 39 to allow handle 16 to rotate. Likewise, each bearing surface 50 interfaces with the bezel 39 to maintain the spacing between backplate 12 and body portion 40.

Along the B side-facing surface of handle 16 there is provided a handle spring post 52 and a spring locator 54. Spring locator 54 includes a slot 56 having a ramp portion 58 and a pocket 60. Torsion spring 20 is pivotally mounted around handle spring post 52. A first arm 62 on torsion spring 20 is retained within pocket 60. A second arm 64 on torsion spring 20 abuts against a groove 66 in the concave region 24 of backplate 12. Preferably, a pair of integrally-formed spring locator tabs 67 helps to locate and retain second arm 64 (FIG. 3). During assembly, handle spring post 52 helps locate and support torsion spring 20. After torsion spring 20 is mounted to handle spring post 52, first arm 62 is inserted into slot 56 and pushed along ramp portion 58 to snap into pocket 60, which retains first arm 62 during both assembly and operation of handle assembly 10.

An arm 68 is provided on the B side-facing side of body portion 40 of handle 16 and extends inwardly. The end of arm 68 is adapted to receive the end of a door cable or cable rod (neither shown) in order to actuate a door latch (also not shown). Preferably, a cable guide 70 is provided on the inside of backplate 12 in order to help route the cable or rod. A first and portion of bumper 18 is seated within a bumper aperture 72 located along an edge of body portion 40. A flared second end portion of bumper 18 abuts against a ramp 76 integrally formed in backplate 12, and provides a dampening effect when handle 16 returns to the resting position.

During assembly, handle 16 is preloaded with torsion spring 20 and bumper 18 prior to mounting to backplate 12. An assembler locates torsion spring 20 around handle spring post 52. Handle spring post 52 helps to retain torsion spring 20 during subsequent assembly steps. The handler next places first arm 62 of the spring 20 into slot 56. By forcing first arm 62 against the incline of ramp portion 58, the first arm is loaded so that it snaps into pocket 60. Once located within pocket 60, first arm 62 remains in place for future assembly steps. Preferably, bumper 18 is seated within bumper aperture 72 prior to mounting handle 16 to backplate 12.

Next, handle 16 is inserted through handle aperture 26 from the B side of backplate 12 at an angle substantially perpendicular to cover plate 12. Pins 44 are aligned adjacent to pivot mounts 32. Pins 44 are placed up against curved surfaces 41 to help locate handle 16. The assembler can now press handle 16 into pivot mounts 32 as the D-flat portions 46 of pins 44 slide through slots 36 and into voids 38 where pins 44 are snap-locked in place. Ramp portions 43 ease the snap-in insertion of handle 16 and function to retain the handle after insertion. As pins 44 move through slots 36, second arm 64 on torsion spring 20 is compressed against groove 66, thereby placing torsion spring 20 under load. Once pins 44 enter voids 38, the assembler releases handle 16, and torsion spring 20 pivots handle 16 into its un-actuated position. During operation, handle 16 is pivoted by an operator between its un-actuated and actuated positions. As with assembly, pivoting handle 16 acts to load torsion spring 20 so that it returns handle 16 to its un-actuated position upon release. As handle 16 moves into its actuated position, the load on torsion spring 20 increases to prevent handle 16 from moving fully perpendicular to backplate 12.

Those skilled in the art will understand that a variety of modifications may be made to the embodiments described herein without departing from the spirit of the invention. For example, pivot mounts 32 may include extended and reinforced walls to provide a greater resiliency against the twisting of the handle. Alternatively, handle assembly 10 may be adapted to other types of closures, such as hatches, lift and tail gates, glove compartment boxes or exterior facing door handle assemblies.

What is claimed is:

1. A method of assembling a handle assembly attachable to a door of a motor vehicle, the method comprising the steps of:

providing the handle assembly comprised of a backplate, a handle and a torsion spring, the backplate having a concave portion adapted to be mounted in a door aperture formed in the door and including a handle aperture and a pair of pivot mounts, each pivot mount including a cylindrical void and an assembly slot interconnecting the handle aperture to the cylindrical void, the handle includes a pair of pivot pins, a spring post, and a spring locator having a slot with a ramp portion and a retention pocket, each pivot pin having a guide segment and a cylindrical pivot segment, the torsion spring having a coiled segment and first and second end segments;

positioning the coiled segment of the torsion spring around the spring post of the handle;

placing the first end segment of the torsion spring through the slot of the spring locator in the handle and sliding the first end segment along the ramp portion until it is retained in the retention pocket;

inserting the handle through the handle aperture in the concave portion of the backplate at an angle generally perpendicular to the backplate to define an assembly position of the handle relative to the backplate;

aligning the guide segments of the pivot pins within the assembly slots of the pivot mounts;

moving the handle relative to the backplate while maintaining the assembly position therebetween for sliding the guide segments of the pivot pins through the assembly slots of the pivot mounts until the cylindrical pivot segments of the pivot pins are located within the cylindrical voids of the pivot mounts;

engaging the second end segment of the torsion spring against the concave portion of the backplate adjacent to an edge of the handle aperture to place the torsion spring under load and bias the handle from its assembly position into a non-actuated position whereat the guide segments of the pivot pins are inhibited from sliding through the assembly slots of the pivot mounts; and wherein the step of positioning the coiled segment of the torsion spring around the spring post of the handle occurs prior to sliding the guide segments of the pivot pins through the assembly slots of the pivot mounts.

2. The method of claim 1 wherein each of the pivot mounts further includes a ramped portion formed adjacent to the assembly slot to provide a snap-in insertion of the cylindrical pivot segments of the pivot pins within the cylindrical voids of the pivot mounts.

3. The method of claim 1 wherein the backplate further includes a groove for retaining the second end segment of the torsion spring therein.

4. The method of claim 3 wherein the backplate further includes a pair of locator tabs aligned with the groove for assisting in retaining and locating the second end segment of the torsion spring.

5. The method of claim 1 further comprising the steps of:

providing a bumper;

installing a first end of the bumper in a bumper aperture formed in the handle; and positioning a second end of the bumper in engagement with a portion of the backplate upon assembly of the handle with the backplate to provide a damping action when the handle is released and returns to its non-actuated position.

6. The method of claim 1 wherein the pivot pins extend outwardly from a body portion of the handle to define a pivot axis upon insertion of the pivot pins within the pivot mounts of the backplate, wherein the backplate includes a perimeter flange and a web portion interconnecting the perimeter flange to the concave portion, and wherein the pivot mounts are formed in the web portion of the backplate.

7. A method of assembling a handle assembly attachable to a door of a motor vehicle, the handle assembly including a backplate, a handle and a torsion spring, the backplate adapted to be mounted to the door and having a handle aperture and a pair of pivot mounts, the handle having a pair of pivot pins, a spring post and a retention pocket, the torsion spring having first and second arm segments, the method comprising the steps of:

positioning a coiled segment of the torsion spring around the spring post of the handle;

placing the first arm segment of the torsion spring within the retention pocket of the handle;

inserting the handle through the handle aperture of the backplate at an angle generally perpendicular to the backplate and which defines an assembly position of the pivot pins relative to the pivot mounts and of the handle relative to the backplate;

inserting a guide segment of each pivot pin into an assembly slot of each pivot mount while maintaining the assembly position therebetween until a pivot segment of each pivot pin is pivotally retained in a void aperture of each pivot mount; and engaging the second arm segment of the torsion spring with the backplate to place the spring under load and cause the handle to be biased toward a non-actuated position whereat the guide segment of each pivot pin is traversely oriented relative to the corresponding assembly slot of each pivot mount;

wherein the step of positioning the coiled segment of the spring around the spring post of the handle occurs prior to the step of inserting the guide segments of the pivot pins into the assembly slots of the pivot mounts.

8. The method as set forth in claim 7 including the step of securing a cover plate to the backplate.

9. The method as set forth in claim 7 including the step of seating a bumper through a bumper aperture in the handle.

10. The method as set forth in claim 9 wherein the seating step occurs prior to the step of inserting the guide segments of the pivot pins into the assembly slots of the pivot mounts.

11. The method as set forth in claim 7 wherein the handle includes a slot connected to the retention pocket which has a ramp portion, and wherein the first arm segment of the spring is initially installed within the slot and guided over the ramp portion so as to be subsequently snapped into the retention pocket.

12. The method as set forth in claim 7 wherein the pivot segment of each pivot pin defines a cylindrical pivot segment, wherein the void aperture in each pivot mount defines a cylindrical void aperture, wherein the guide segment of each pivot pin extends from a corresponding one of the cylindrical pivot segments and includes flat edge portions sized to only permit sliding movement of the guide segments into and through the assembly slots of the pivot mounts when the handle is maintained in the assembly position relative to the backplate, and wherein the torsion spring is configured to bias the handle to pivot from its assembly position toward its non-actuated position so as to orient the flat portions of the pivot pins transversely to the assembly slots, thereby inhibiting removal of the handle from the backplate.

13. The method as set forth in claim 12 wherein retention of the cylindrical pivot segments of the pivot pins in the cylindrical void apertures of the pivot mounts permits pivotal movement of the handle from its non-actuated position into an actuated position in opposition to the biasing of the torsion spring, and wherein the actuated position of the handle is located between the non-actuated position and the assembly position of the handle.

14. The method of claim 7 wherein each pivot mount further includes a ramped portion formed adjacent to the assembly slot to provide a snap-in insertion of the pivot segments of the pivot pins within the void apertures of the pivot mounts.

15. The method of claim 7 wherein the backplate further includes a groove for retaining the second arm segment of the torsion spring therein.

16. The method of claim 15 wherein the backplate further includes a pair of locator tabs aligned with the groove for assisting in retaining and locating the second arm segment of the torsion spring.

17. The method of claim 7 further comprising the steps of:

providing a bumper;

installing a first end of the bumper in a bumper aperture formed in the handle; and positioning a second end of the bumper in engagement with a portion of the backplate upon assembly of the handle with the backplate to provide a damping action when the handle is released and returns to its non-actuated position.

18. A method of assembling a handle assembly attachable to a door of a motor vehicle, the method comprising the steps of:

providing the handle assembly comprised of a backplate, a handle and a torsion spring, the backplate having a concave portion adapted to be mounted in a door aperture formed in the door and including a handle aperture and a pair of pivot mounts, each pivot mount including a cylindrical void and an assembly slot interconnecting the handle aperture to the cylindrical void, the handle includes a pair of pivot pins, a spring post, and a spring locator having a slot with a ramp portion and a retention pocket, each pivot pin having a guide segment and a cylindrical pivot segment, the torsion spring having a coiled segment and first and second end segments;

positioning the coiled segment of the torsion spring around the spring post of the handle;

placing the first end segment of the torsion spring through the slot of the spring locator in the handle and sliding the first end segment along the ramp portion until it is retained in the retention pocket;

inserting the handle through the handle aperture in the concave portion of the backplate at an angle generally perpendicular to the backplate to define an assembly position of the handle relative to the backplate;

aligning the guide segments of the pivot pins within the assembly slots of the pivot mounts;

moving the handle relative to the backplate while maintaining the assembly position therebetween for sliding the guide segments of the pivot pins through the assembly slots of the pivot mounts until the cylindrical pivot segments of the pivot pins are located within the cylindrical voids of the pivot mounts;

engaging the second end segment of the torsion spring against the concave portion of the backplate adjacent to an edge of the handle aperture to place the torsion spring under load and bias the handle from its assembly position into a non-actuated position whereat the guide segments of the pivot pins are inhibited from sliding through the assembly slots of the pivot mounts; and wherein the guide segments associated with each of the pivot pins includes a pair of flat portions sized to only permit sliding movement of the guide segments through the assembly slots of the pivot mounts when the handle is in its assembly position relative to the backplate, and wherein the torsion spring is operable to forcibly bias the handle from its assembly position into its non-actuated position so as to permit the cylindrical pivot segments of the pivot pins to be retained within the cylindrical voids of the pivot mounts and subsequently permit pivotal movement of the handle from its non-actuated position into an actuated position in opposition to the biasing of the torsion spring.

19. The method of claim 18 wherein the actuated position of the handle relative to the backplate is located between the non-actuated position and the assembly position of the handle.

20. The method of claim 19 wherein the step of positioning the coiled segment of the torsion spring around the spring post of the handle occurs prior to sliding the guide segments of the pivot pins through the assembly slots of the pivot mounts.

21. The method of claim 18 wherein the step of positioning the coiled segment of the torsion spring around the spring post of the handle occurs prior to sliding the guide segments of the pivot pins through the assembly slots of the pivot mounts.

22. A method of assembling a handle assembly adapted for attachment within a door aperture of a door in a motor vehicle, the method comprising the steps of:

providing a handle assembly comprised of a backplate, a handle and a biasing spring, the backplate including a concave portion configured to be mounted in the door aperture and a peripheral web portion, the concave portion defining a handle aperture and the web portion defining a pair of pivot mounts, each pivot mount having an assembly slot interconnecting the handle aperture to a pivot seat, the handle including a handle portion and a body portion having a spring post, a locator pocket and a pair of pivot pins, each pivot pin having a guide section and a pivot section, the biasing spring including first and second arm segments interconnected by a coiled segment;

installing the coiled section of the biasing spring on the spring post of the handle and locating the first arm segment of the biasing spring in the locator pocket;

inserting the handle portion of the handle aperture in the backplate;

aligning the handle in an assembly position relative to the backplate, the assembly position being defined when the guide sections of the pivot pins are aligned with the assembly slots of the pivot mounts for sliding movement into the assembly slots;

moving the body portion of the handle relative to the backplate while the handle is maintained in its assembly position until the guide sections of the pivot pins have passed through the assembly slots of the pivot mounts so as to position the pivot sections of the pivot pins within the pivot seats of the pivot mounts;

engaging the second arm segment of the biasing spring with the backplate and releasing the handle so as to permit the biasing spring to forcibly pivot the handle from its assembly position into a non-actuated position where the handle portion of the handle is disposed within the concave portion of the backplate;

wherein the handle is pivotable from its non-actuated position into an actuated position relative to the backplate, and wherein the guide sections of the pivot pins are misaligned and inhibited from entering the assembly slots of the pivot mounts when the handle is in its actuated and non-actuated positions; and the step of installing the coiled section of the biasing spring on the spring post of the handle occurs before passing the pivot pins through the assembly slots of the pivot mounts.

* * * * *